United States Patent [19]

Heppner et al.

[11] 4,242,180

[45] Dec. 30, 1980

[54] AMMONIA FREE PALLADIUM ELECTROPLATING BATH USING AMINOACETIC ACID

[75] Inventors: Klaus-Dieter Heppner; Hans-Joachim Schuster, both of Berlin, Fed. Rep. of Germany

[73] Assignee: Siemens Aktiengesellschaft, Berlin & Munich, Fed. Rep. of Germany

[21] Appl. No.: 2,965

[22] Filed: Jan. 12, 1979 (Under 37 CFR 1.47)

Related U.S. Application Data

[63] Continuation-in-part of Ser. No. 863,044, Dec. 21, 1977, Pat. No. 4,144,141.

[30] Foreign Application Priority Data

Dec. 21, 1976 [DE] Fed. Rep. of Germany ..... 2657925

[51] Int. Cl.[3] ..... C25D 3/52

[52] U.S. Cl. ..... 204/43 N; 204/47

[58] Field of Search ..... 204/43 N, 47, 109, 123; 106/1.24, 1.28

[56] References Cited

U.S. PATENT DOCUMENTS

| | | | |
|---|---|---|---|
| 3,376,206 | 4/1968 | Kahan et al. | 204/47 |
| 3,458,409 | 7/1969 | Hayashi et al. | 204/43 N |
| 3,933,602 | 1/1976 | Henzi et al. | 204/44 |
| 4,144,141 | 3/1979 | Schuster et al. | 204/47 |

FOREIGN PATENT DOCUMENTS

| | | |
|---|---|---|
| 2419814 | 11/1974 | Fed. Rep. of Germany . |
| 2506467 | 8/1976 | Fed. Rep. of Germany . |
| 1014045 | 12/1965 | United Kingdom . |

OTHER PUBLICATIONS

O. V. Izbekova et al., Zashchita Metallov, vol. 9, No. 1, pp. 108–110, (1973).

Chemical Abstracts, vol. 78, 118401v, p. 505, (1973).

Chemical Abstracts, vol. 80, 115390w, p. 503, (1974).

*Primary Examiner*—G. L. Kaplan

*Attorney, Agent, or Firm*—Hill, Van Santen, Steadman, Chiara & Simpson

[57] ABSTRACT

An aqueous ammonia-free bath for galvanic deposition of palladium or palladium alloys and a process for using involving the use of aminoacetic acid as the sole complexing agent for palladium or palladium alloys in ammonium free, alkaline aqueous media.

6 Claims, No Drawings

AMMONIA FREE PALLADIUM ELECTROPLATING BATH USING AMINOACETIC ACID

RELATED APPLICATION

This application is a continuation-in-part of my earlier filed U.S. patent application Ser. No. 863,044, filed Dec. 21, 1977, now U.S. Pat. No. 4,144,141.

BACKGROUND OF THE INVENTION

The field of this invention is galvanic deposition of palladium or palladium alloys using aqueous plating baths.

In electrical engineering, palladium coatings produced by galvanic deposition are used as favorably priced alternatives for galvanic hard gold coatings on contact components, such as plug connectors, for example. For this application, the palladium coatings must have uniformly semi-bright to bright surfaces, and be sufficiently ductile and pore-free. The baths used for galvanic deposition have to be of simple composition and easy to top up so as to ensure uniform quality in the coatings deposited.

Galvanic baths producing coatings which meet the named conditions operate in the alkaline pH range (e.g., over pH 7) mostly at high temperature, and contain substantial quantities of ammonia which has to be present mainly to form the amine complexes needed for deposition.

With these known baths, the constantly evaporating ammonia causes considerable difficulties in controlling the pH value. Ammonia has to be added continuously in metered quantities for the optimum pH range to be maintainable. In addition, the unpleasant and annoying odor of the evaporating ammonia makes the use of a ventilator means necessary. One further disadvantage is that, in the case of partial coating with palladium, basic material containing copper is corroded by the ammonia vapors, and the corrosion products can contaminate the bath, and thereby change the technological properties of the deposited coatings for the worse.

A known bath for galvanic deposition of palladium nickel alloys also contains aminoacetic acid, but here, through the addition of ammonia, an alkaline pH value is set at which the palladium is present as an ammine complex and not as an aminoacetic acid complex (Isbekowa D. V., Kudra O. K. Tschelikidi V. V., USSR, Saschtschita Metallow, vol. IX No. 1/73, pp 108–110).

BRIEF SUMMARY OF THE INVENTION

More particularly, this invention is directed to the use of aminoacetic acid as a sole complexing agent for palladium or palladium alloys in an ammonium (and ammonia) free aqueous alkaline plating bath, and to a process for achieving plating of palladium or palladium alloys involving the use of such a bath.

A primary object of the present invention is to provide an aqueous, ammonia-free palladium containing bath for galvanic deposition of palladium or palladium alloys which allows a desired pH range to be maintained exactly and which can be operated without any ventilator.

Another object is to provide an improved technique for plating palladium and palladium alloys without using ammonium-containing aqueous media.

DETAILED DESCRIPTION

By the present invention, a galvanic deposition bath contains palladium in the form of a diglycinate palladium (II) complex using aminiacetic acid as the sole complexing agent. Such a bath gives pore-free, ductile and bright palladium or palladium alloy coatings of constant quality and does not give rise to any difficulties as regards the maintenance of a pH range found to be an optimum. No ventilator is required.

In the prior art, the use of aminoacetic acid as a sole complexing agent for the deposition of palladium or palladium alloys from an ammonia-free aqueous solution was unknown.

An aqueous bath in accordance with the present invention contains a diglycinate palladium (II) complex representable by the formula:

$$Pd(OOCCH_2NH_2)_2 \quad (1)$$

A bath containing such complex can be produced by any convenient procedure. For example, one can precipitate out palladium as a hydroxide from an aqueous $PdCl_2$ solution followed by dissolution of hydroxide in aminoacetic acid aqueous solution, or by reacting a dissolved water solution palladium salt (such as with dissolved aminoacetic acid) where the anionic residue is removed by conventional measure or is allowed to remain in the bath.

The bath can also additionally contain conducting salts, and buffer reagents, such as chlorides, phosphates, citrates, acetates, and the like. The bath can also contain complexing agents like ethylenediamine-tetraacetic acid or nitrilotriacetic acid for complexing non-palladium metallic impurities, surface active substances, or the like. The respective quantities of such additives employed in any given bath of the invention is similar to that used in prior art ammonium containing palladium plating baths.

Preferably, the palladium concentration in a bath of this invention ranges from about 1 to 50 g/l and preferably the quantity of aminoacetic acid (based on total weight of added acid) ranges from about 1 to 150 g/l in such a bath solution. Moreover, the bath is advantageously set to a pH value ranging from about 7 to 12 with alkali metal hydroxide. The alkali metal hydroxide is preferably preliminarily dissolved in water to make up a 50 to 20 weight percent solution (10% being presently preferred) and then added to a previously prepared palladium solution. Preferred alkali metal hydroxides are sodium hydroxide and potassium hydroxide.

When palladium alloy coatings or platings are to be deposited from a bath of this invention, the alloying metals, if such are being used, are preferably added to a bath in the form of water soluble salts. Examples of alloying metals include nickel, cobalt and silver. The total quantity of such alloying metals employed can extend from up to about 50 grams per liter in any given bath. Within this range, the amount of such alloying metal can sometimes be determined by the respective solubility limits of the metal salts employed.

Thus, a preferred palladium galvanic deposition bath of this invention comprises an aqueous solution having dissolved palladium therein in the form of a diglycinate palladium (II) complex represented by the formula:

$$Pd(OOCCH_2NH_2)_2 \quad (1)$$

said solution being further characterized by containing:

(A) from about 1 to 50 grams per liter of dissolved palladium, (B) from about 0 to 50 grams per liter of at least one other dissolved alloying metal (nickel, silver and/or cobalt), (C) from about 1 to 150 grams per liter of total added aminoacetic acid, (D) sufficient dissolved alkali metal hydroxide to a solution pH ranging from about 7 to 12.

When such bath does contain such additional dissolved alloying metals such are preferably present in an amount ranging from about 0.1 to 50 grams per liter.

Suitable substrates for palladium or palladium alloy coating using a bath of this invention include metals, such as copper, iron (including steel), and like metals used as contact components in electrical devices, circuits, etc. Presently preferred palladium coatings produced by using a bath of this invention contain at least about 50 weight percent palladium on a 100 weight percent total coating basis. In any given instance, a product coating produced from a bath of this invention has a composition which is determined by the selection of the metal components contained in such bath.

A preferred process for using a bath of this invention involves the steps of (A) applying through a bath of this invention as above described a current density ranging from about 0.2 to 1.5 A/dm$^2$, and (B) immersing into, and maintaining in, such bath an object whose immersed, exposed surface portions are to be plated (or coated) with palladium, or a palladium alloy as the case may be, for a time sufficient to develop on such exposed surface portions a palladium or palladium alloy coating of desired thickness.

EMBODIMENTS

The present invention is further illustrated by reference to the following examples. Those skilled in the art will appreciate that other and further embodiments are obvious and within the spirit and scope of this invention from the teachings of these present examples taken with the accompanying specification. The quantities indicated for the individual components relate in each case to one liter of aqueous solution.

EXAMPLE 1

An aqueous solution having the following composition is prepared:

Pd in form of $Pd(CH_2NH_2COO)_2$: 10 g/l

Aminoacetic acid: 50 g/l

Ethylenediaminetetraacetic acid: 5 g/l

To the resulting solution is added sufficient 10% aqueous solution of potassium hydroxide to produce a product solution having a pH of 9 while maintaining a solution temperature of 60° C.

When a current density of 1.0 A/dm$^2$ is applied across a bath comprised of such product solution, it is found that the bath gives a bright, abrasion-resistant palladium coating on a clean copper substrate surface. The current yield is 100%.

EXAMPLE 2

An aqueous solution having the following composition is prepared:

Pd in the form of $Pd(CH_3COO)_2$: 8 g/l

Aminoacetic acid: 20 g/l

Potassium dihydrogen phosphate: 50 g/l

Nitrilotriacetic acid: 10 g/l

To the resulting solution is added sufficient 10% aqueous solution of potassium hydroxide to produce a product solution having a pH of 8 while maintaining a solution temperature of 25° C.

When a current density of 0.2 A/dm$^2$ is applied across a bath comprised of such product solution the bath gives a bright, pore-free coating on a clean copper substrate surface. Coating hardness equals 230 kp/mm$^2$.

EXAMPLE 3

An aqueous solution having the following composition is prepared:

Pd in the form of $PdCl_2$: 20 g/l

Ni in the form of $NiSO_4.6\ H_2O$: 20 g/l

Aminoacetic acid: 100 g/l

Sodium chloride: 50 g/l

To the resulting solution is added sufficient 10% aqueous solution of sodium hydroxide to produce a product solution having a pH of 8 while maintaining a solution temperature of 45° C.

When a current density of 0.5 A/dm$^2$ is applied across a bath comprised of such product solution, the bath gives a hard, abrasion-resistant palladium nickel alloy coating on a clean copper substrate surface.

EXAMPLE 4

An aqueous solution having the following composition is prepared:

Pd in the form of $Pd(CH_2NH_2COO)_2$: 5 g/l

Ag in the form of $Ag_2SO_4$: 10 g/l

Aminoacetic acid: 100 g/l

To the resulting solution is added sufficient 10% aqueous solution of sodium hydroxide to produce a product solution having a pH of 10 while maintaining a solution temperature of 50° C.

When a current density of 0.4 A/dm$^2$ is applied across a bath comprised of such product solution, the bath gives a smooth, pore-free palladium-silver coating on a clean copper substrate surface.

EXAMPLE 5

An aqueous solution having the following composition is prepared:

Pd in the form of Pd: 2 g/l

Co in the form of: 15 g/l

Aminoacetic acid: 120 g/l

To the resulting solution is added sufficient 10% aqueous solution of sodium hydroxide to produce a product solution having a pH of 7.8 while maintaining a solution temperature of 55° C.

When a current density of 0.4 A/dm$^2$ is applied across a bath comprised of such product solution, the bath gives a smooth, pore-free palladium-cobalt coating on a clean copper substrate surface.

EXAMPLE 6

An aqueous solution having the following composition is prepared:

Pd in the form of: 4 g/l

Ni in the form of: 12 g/l

Co in the form of: 6 g/l

Aminoacetic acid: 90 g/l

Sodium chloride: 10 g/l

To the resulting solution is added sufficient 10% aqueous solution of potassium hydroxide to produce a product solution having a pH of 8.4 while maintaining a solution temperature of 65° C.

When a current density of 0.6 $A/dm^2$ is applied across a bath comprised of such product solution, the bath gives a hard, abrasion-resistant palladium nickel cobalt alloy coating on a clean copper substrate surface.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto-appended claims.

We claim:

1. An aqueous ammonia-free bath for galvanic deposition of metal selected from the group consisting of palladium and palladium alloys wherein said palladium is present in the form of a diglycinate palladium II complex in which aminoacetic acid is the complexing agent said bath being further characterized by containing (A) from about 1 to 50 grams per liter of dissolved palladium, (B) from and including 0 to 50 grams per liter of at least one other metal selected from the group consisting of silver, nickel and cobalt, (C) from about 1 to 150 grams per liter of total added aminoacetic acid, and (D) sufficient dissolved alkali metal hydroxide to produce a bath pH ranging from about 7 to 12.

2. The bath of claim 1 wherein said alkali metal hydroxide consists essentially of sodium hydroxide.

3. The bath of claim 1 wherein said alkali metal hydroxide consists essentially of potassium hydroxide.

4. The bath of claim 1 wherein said diglycinate palladium II complex is represented by the formula:

$$Pd(OOCCH_2NH_2)_2.$$

5. The bath of claim 1 wherein said metal consists essentially of palladium.

6. The bath of claim 1 containing from about 0.1 to 50 grams per liter of said other metal.

* * * * *